US006164001A

United States Patent [19]

Lee

[11] Patent Number: 6,164,001

[45] Date of Patent: Dec. 26, 2000

[54] DEVICE FOR REDUCING FIREARMS TRIGGER PULL WEIGHT

[76] Inventor: Roberto R. Lee, 352 W. Lomita Ave. #9, Glendale, Calif. 91204

[21] Appl. No.: 09/106,690

[22] Filed: Jun. 29, 1998

[51] Int. Cl.[7] ..... F41A 19/00

[52] U.S. Cl. ..... 42/69.01

[58] Field of Search ..... 42/69

[56] References Cited

U.S. PATENT DOCUMENTS

| | | | |
|---|---|---|---|
| 1,285,954 | 11/1918 | Diehm | 42/69.01 |
| 3,184,875 | 5/1965 | Klebe | 42/69.01 |
| 4,344,351 | 8/1982 | McQueen | 42/69.01 |
| 4,447,977 | 5/1984 | Holmgren | 42/69.01 |
| 4,955,155 | 9/1990 | Jones | 42/69.01 |
| 4,986,019 | 1/1991 | Dennis, Jr. | 42/69.01 |
| 5,038,507 | 8/1991 | Dennis, Jr. | 42/69.01 |
| 5,400,536 | 3/1995 | Milliman | 42/69.01 |
| 5,822,903 | 10/1998 | Davis, Sr. | 42/69.01 |
| 5,962,804 | 10/1999 | Lee | 42/69.01 |

OTHER PUBLICATIONS

Vol. 4 No. 2 May 1998 Gun Games Magazine.
Brochure Gun Craft.
Brochure Para–Ordnance.
Brochure Kings Gun Works.
Brochure 1998 SVI and STI.
1995 Spring Field Armory.

*Primary Examiner*—Charles T. Jordan
*Assistant Examiner*—Denise J Buckley

[57] ABSTRACT

A device comprises of independent trigger bow (58) supplied with overlapping recess (64) and a trigger block (10) having a bow guide recess (20), pivot hole (14) with axis pin (34A), primary lever (28) having a axis hole (30) at one end and a bow extender recess (32) and a trigger plate (36A) having a pre-load bar (56) and stopper bar (54) that can be assembled into a module to allow easy installation on trigger tunnel (85) of firearm(88) for reduce firearm trigger pull weight without altering firearm (88). Block (10) is being equipped with catches (12) extending sideways and adjacent with bow guide recess (20) which will overlap with recess (64) of bow (58) to allow both the bow (58) and block (10) to occupy in one same area which allow anchoring against a bow tunnel (83) end wall and supplied with magazine cut (15) disposed on the upper left of block (10) to allow for a magazine passage. As trigger plate (36A) is depressed with finger within a given point on trigger plate (36A) upon firing the finger force will be shifted directly into the adjustable preload bar (56) and synchronizes into the outermost lever end at point (27) of lever (28) producing a high torque leverage which reduces firearm trigger pull weight or load force from the trigger bow (58) energized from sear (70), hammer (72) and hammer spring (82). The trigger plate (36A) being retained with pivot pin (34A) through retaining slot (40A) is supplied with plate bearing (42) and bottom bearing (48) will slide against a frame upper bearing (79) and against s block plate bearing (17) of block (10) respectively, will function as an advancing global pivot point which will changed a rotational action of lever (28) into a linear straight pull action to maintain firearm standard straight action and reducing the trigger pull weight.

3 Claims, 5 Drawing Sheets

56
54
38D
36D
44
40B
42
39
43
46
48

56
54
38C
36C
44
40B
42
39
43
46
48
29
30B
32
34B
13
26
14
12
16
12
11
22
17
24

38B
18
36B
40A
44
42
40A
39
43
46
48

58
60
62
64
68
62

TRIGPAT1.DWG

TRIGPAT3.DWG 9B
9B
79
85
75
80
83
87
88
38
11
42
48
34A
12
20
16
18
10
22
24
60
58
70
94
91
85
83
80
79
85
83
87
75

DEVICE FOR REDUCING FIREARMS TRIGGER PULL WEIGHT

BACKGROUND

1. Field of Invention

This invention relates to firearms and more particularly to a new device wherein the applied trigger finger force is being multiplied to reduce firearms trigger pull weight.

2. Description of Prior Art

Originally, automatic firearms such as a John Browning 1911 series, modified and improved versions are being supplied with a standard trigger that are made of rigid single or integral piece trigger bar assembly having a sliding or linear straight pull action when depressed upon firing.

In target shooting competitions and for other special use, firearms are mostly being altered or adjusted to reduce the trigger pull weight by narrowing the engagements between the hammer sear and sear as well as adjustments to springs and other related parts to increase accuracy. The standard integral piece trigger is often replaced with after market light weight trigger bars which minimizes vibration momentum that causes premature hammer fall or hammer follow also of integral piece.

Thereafter, inventors and designers have created types of triggers that are made of light weight materials such as a titanium bow attached with a carbon fiber trigger shoe to minimize vibration momentum and a pivoting trigger in a way to reduce the trigger pull weight. U.S. Pat. No. 5,955,155 to Jones which discloses a leverage to reduce the felt trigger pull weigh, however, the line of resisting load or force from the stirrup position is so arranged being in-line with the trigger finger will eventually minimizes leverage advantage and also requires drilling hole on the firearms. Nevertheless, all the triggers heretofore known suffer from a number of disadvantages.

(a) The prior arts single piece triggers are mow made of different combination of lightweight materials but still do not reduce trigger pull weight.

(b) The prior art pivoting trigger device is obviously disadvantageous since the basic straight pull is being altered into a pivoting trigger pull action and produces inconsistent trigger pull weight each time the trigger finger depresses the pivot trigger set closer or farther away from the pivot pin.

(c). The prior art pivoting trigger device is also highly disadvantageous since it discloses the need for drilling and threading of hole on firearms upon installation.

(d) The prior art pivoting trigger device discloses a fixed stirrup post which requires trim cutting for obtaining correct contact between the sear, stirrup and the pivoting trigger by trial and error method and requires full disassembly and assembly every slight cutting until a correct trigger play is achieved which is a very laborious, lengthy and tiresome process for a slight adjustments and requires to be replaced if it is overly cut and can be done in a gun shop only.

(e) The prior art pivoting trigger device is highly disadvantageous since it can be rendered inoperable if either hammer or sear is being replaced which would require a new stirrup post and repeat of the tedious and lengthy adjustments process.

(f) The prior art pivoting trigger device is obviously highly disadvantageous since the trigger finger must be preferably positioned towards the outer end of trigger and opposite from the pivot pin to achieved a lighter trigger pull weight which is a difficult move to achieved especially in speed shooting which gives no time for repositioning of the trigger finger.

(f) The prior art pivoting trigger device is obviously highly disadvantageous since the middle portion on the pivoting trigger requires to be undercut to allow the trigger finger be in contact at the lower portion of the trigger to attain leverage and still with minimum result.

OBJECTS AND ADVANTAGES

Accordingly, several objects and advantages of the present invention are:

(a) to provide a trigger device for firearm that can be provided with a combination of rotational and straight pull acting leverages being equipped with trigger enclosure which changes from axial to linear straight pull action to maintain firearms basic straight pull action and the leverage will substantially increase the applied finger force that will greatly reduce firearm trigger pull weight.

(b) to provide a trigger enclosure for the trigger device equipped having bearing surfaces that provide as enclosure for the link and the secondary enclosure and when assembled will form as a module that allows easy assembly on firearms.

(c) to provide a trigger enclosure for the trigger device supplied with spacer guide recess used as an entry for overlapping with the trigger spacer and being equipped with right and left integral catches that are extending sideways to provide a self anchoring capability and to eliminate firearm alterations upon installation of the trigger device.

(d) to provide a enclosure for the trigger device with the rear bottom portion is being supplied with an arced recess used as an entry for the magazine release-button, as a stopper and also as a torque thrust support for the link while allowing the magazine release button perform its basic function to slide in and out when depressed.

(e) to provide a trigger device comprising a secondary enclosure having the top and bottom bearing surfaces are utilized as an advancing global pivot point support that will allow the secondary enclosure obtain a straight pull action.

(f) to provide a spacer for the trigger device that are made of various inside opening width to allow use of a standard capacity or high capacity firearms magazines and can be made of different types of lightweight, non-corrosive and high strength materials.

(g) to provide a spacer for the trigger device preferably with the forward top section is being provided with recess to allow spacer to slide and overlaps inside the spacer recess of the enclosure just bellow the catches to allow the spacer to set fully forward to its proper position as required and also will allow the catches of the enclosure to anchor fully forward against the receiver.

(h) to provide a trigger device comprises a spacer that is movable independently and the front end is being provided with a nose thrust for engagement against a link and also the height of the nose thrust can be varied that will convert the trigger pull weight and length from start to fire.

(i) to provide a with enclosure for the trigger device that can be provided with a primary rotational link and a secondary enclosure supplied with pre-load screw for converting to straight trigger pull action and allows consistent minimum trigger pull weight conversion.

(j) to provide a trigger device that can be provided with either a rotational trigger pull or a straight pull actions to provide options for shooters with varied shooting styles and preference.

(k) to provide an enclosure for the trigger device supplied with rotational link that can be arrange in an upward position and also the corresponding pre-load screw is moved above of the secondary enclosure so that when shooting hand is gripping the firearm to its highest arc support the trigger finger will naturally align with the pre-load screw.

(l) to provide a enclosure for the trigger device with the button stopper recess can be equipped with replaceable spacer to obtain proper fit with the magazine release button which when used on another firearm other where it was first fitted.

(m) to provide a enclosure for the trigger device with the front section can be cut with an arced shape to increase finger backward movement and prevent obstruction when depressing the secondary enclosure upon firing.

(o) to provide a enclosure for the trigger device provided with link holes and pins that are arranged in a way when the enclosure is inserted fully into trigger tunnel on firearm the pivot holes and pins will be covered by the frame itself which eliminates use of additional pin retainer.

(p) to provide a trigger plate for the device with the width that is being reduced to allow fitting inside the open space on the trigger block and firearm and to obtain with more precise finger point contact feel against the secondary enclosure for the trigger device having sufficient width for sliding inside the bearing surfaces of the main enclosure and firearm receiver.

(q) to provide a secondary enclosure for trigger device with the forward portion can be provided with an arced shaped finger recess to provide option of obtaining maximum surface contact area between the trigger finger and trigger plate.

(r) to provide a secondary enclosure for the trigger device being equipped with adjustable trigger pre-load screw that is being set to engaged on the outermost end section of the link to produce maximum torque leverage and at the same time is set to function as a point contact synchronizer so that wherever finger touches and sets on the secondary enclosure regardless if it is set higher or lower the force of the trigger finger will be shifted into the pre-load screw and directly into the outermost end of the link obtaining consistent maximum leverage length which produces a high torque at all times.

(s) to provide a secondary enclosure for the trigger device being equipped with adjustable pre-load screw to allow use of new or modified hammer or sear, provide easy and fast adjustments, attain shooters preferred trigger take-up, saving time and costs for new sets of hammer or sear.

(t) to provide a secondary enclosure for the trigger device being equipped with trigger stopper screw that limits secondary enclosure backward over-travel movement after hammer break off to minimize muzzle jerking and improved accuracy.

(u) to provide a spacer and enclosure for trigger device that can be made of light weight materials such as titanium, aircraft aluminum, plastic composite and other advanced lightweight high strength materials to achieved best trigger performance.

(v) to provide a secondary enclosure for the trigger device being equipped with right and left retaining slots that can be disposed preferably on the upper stabilizer bar and which utilizes the link pin as retainer for the secondary enclosure.

(w) to provide with trigger device which when the trigger elements are assembled inside the enclosure will transformed block into module to allow easy and fast installation and removal on firearms.

Furthermore, the objects and advantages of the present invention is to provide a trigger device that can be self-anchoring on firearms and eliminate firearms alteration, converts the pull weight and the straight pull action, the device comprising of a spacer, link and link pin, a enclosure being equipped with bearing surfaces, catches and link hole, a secondary enclosure being equipped with retaining slot, adjustable stopper and preload screws, the enclosure being equipped with catches on each sides will allow self-anchoring on firearm receiver and the bearing surfaces on the open space of the enclosure is provided for the secondary enclosure to slide inside the enclosure and the link hole on the enclosure is so arranged so that when the enclosure is installed the link hole will be covered by the firearm receiver which will then retain the link pin and link and also the link pin is retaining the secondary enclosure through the retaining slots thereby eliminating the use of additional retaining parts and the secondary enclosure equipped with adjustable stopper and pre-load screws when depressed for firing will slide straight ward allowing the adjustable pre-load screw to engaged with the outer end of the link consistently producing with high torque against the spacer releasing the hammer and sear engagement and within this time the adjustable stopper screw will limit the over-travel upon contact against the link in-line with link pin.

SUMMARY

In accordance with the present invention a trigger pull weight and action converter comprising a enclosure equipped with open space along the center portion and catches on each sides, link, link pin, a secondary enclosure equipped with stopper and pre-load screws and a link channel along the central portion and a spacer.

DRAWING FIGURES

In the drawings, closely related figures have the same numbers but different alphabetic suffixes.

FIGS. 8B shows hammer lockworks back to ready position, slide is pressing disconnector down to reset hammer and sear engagements after trigger device is released forward at standby position.

Figures 1A, 1B, 2A, 2B:
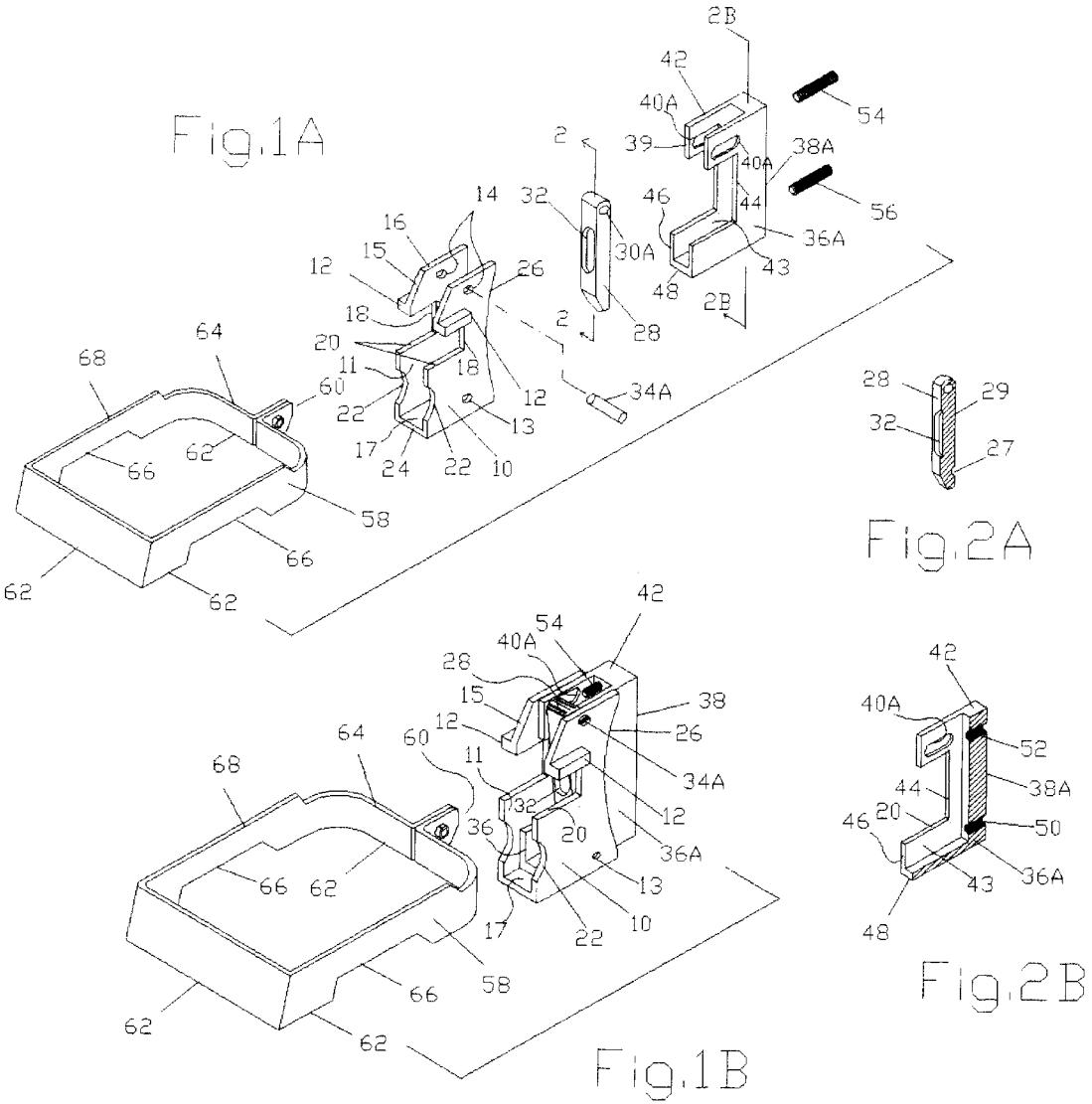
FIGS. 1A and 1B show the exploded view and a partially assembled enclosure of the device.
FIG. 2A shows a cross section of link in a downward position and also shows a thrust dimple.
FIG. 2B shows a cross section of secondary enclosure also showing the pre-load and stopper holes

| Reference Numeral | |
|---|---|
| 10 | enclosure |
| 11 | side bearing surface |
| 12 | catch |
| 13 | lower link hole |
| 14 | upper link hole |
| 15 | magazine cut |
| 16 | block top support |
| 17 | lower bearing surface |
| 18 | spacer |
| 20 | spacer-guide |
| 22 | button recess |
| 24 | enclosure bottom support |
| 26 | enclosure finger recess |
| 27 | dimple |
| 28 | downward link |
| 29 | upright link |
| 30A | pin hole |
| 30B | bottom link hole |
| 32 | spacer nose guide |
| 34A | upper link pin |
| 34B | lower link pin |
| 36A | secondary enclosure |
| 36B | arced secondary enclosure |
| 36C | bottom slotted straight plate |
| 36D | reversed arced secondary enclosure |
| 38A | straight finger thrust |
| 38B | arced finger thrust |
| 38C | arced cut front support |
| 38D | straight cut support |
| 39 | upper stabilizer bar |
| 40A | upper retaining slot |
| 40B | bottom retaining slot |
| 42 | secondary top bearing |
| 43 | link channel |
| 44 | link/cover |
| 46 | bottom stabilizer bar |
| 48 | secondary bottom bearing |
| 50 | pre-load bar hole |
| 52 | stopper bar hole |
| 54 | stopper screw |
| 56 | pre-load screw |
| 58 | spacer |
| 60 | spacer nose |
| 62 | spacer bottom bearing |
| 64 | spacer overlapping recess |
| 66 | spacer weight cut |
| 68 | spacer top support |
| 70 | changer button |
| 71 | hammer pin |
| 72 | hammer |
| 73 | sear pin |
| 74 | sear |
| 75 | frame support |

-continued

| Reference Numeral | |
|---|---|
| 76 | safety grip |
| 77A | lockworks springs |
| 77B | disconnector spring |
| 77C | sear spring |
| 78 | strut rod |
| 79 | receiver upper bearing |
| 80 | button hole |
| 81 | plunger cap |
| 82 | hammer spring |
| 83 | receiver spacer tunnel |
| 84 | retaining plunger |
| 85 | receiver enclosure tunnel |
| 86 | spring housing |
| 87 | receiver spacer channel |
| 88 | lower frame |
| 90 | firearm slide |
| 91 | integral ramp |
| 92 | resetting cut |
| 96 | integral ramp |

PREFERRED EMBODIMENT

Description—FIGS. 1A, 1B, 2A, 2B

A preferred embodiment of a trigger converter of the present invention is illustrated in FIG. 1A and FIG. 1B (perspective views). The trigger converter being equipped of an enclosure 10 provided with catch 12 on each side that allows self-anchoring to the receive spacer tunnel 83. Plurality of bearing surfaces 11 and 17 arranged on the center to allow a secondary enclosure 36A to slide to and fro.

The enclosure of the converter device has a link hole 14 that passes through on each side for inserting a link pin 34A for retaining a link 28 and also retains the secondary enclosure 36A through slot 40A that will allow secondary enclosure to slide to and fro. Also, the enclosure has a button recess 22 for engaging with a changer button 70 with a sliding fit and above the button recess is provided with a spacer recess 20 that allow the overlapping guide 64 and spacer nose 60 on spacer 58 to overlap inside.

Figures 4, 5, 6, 7:
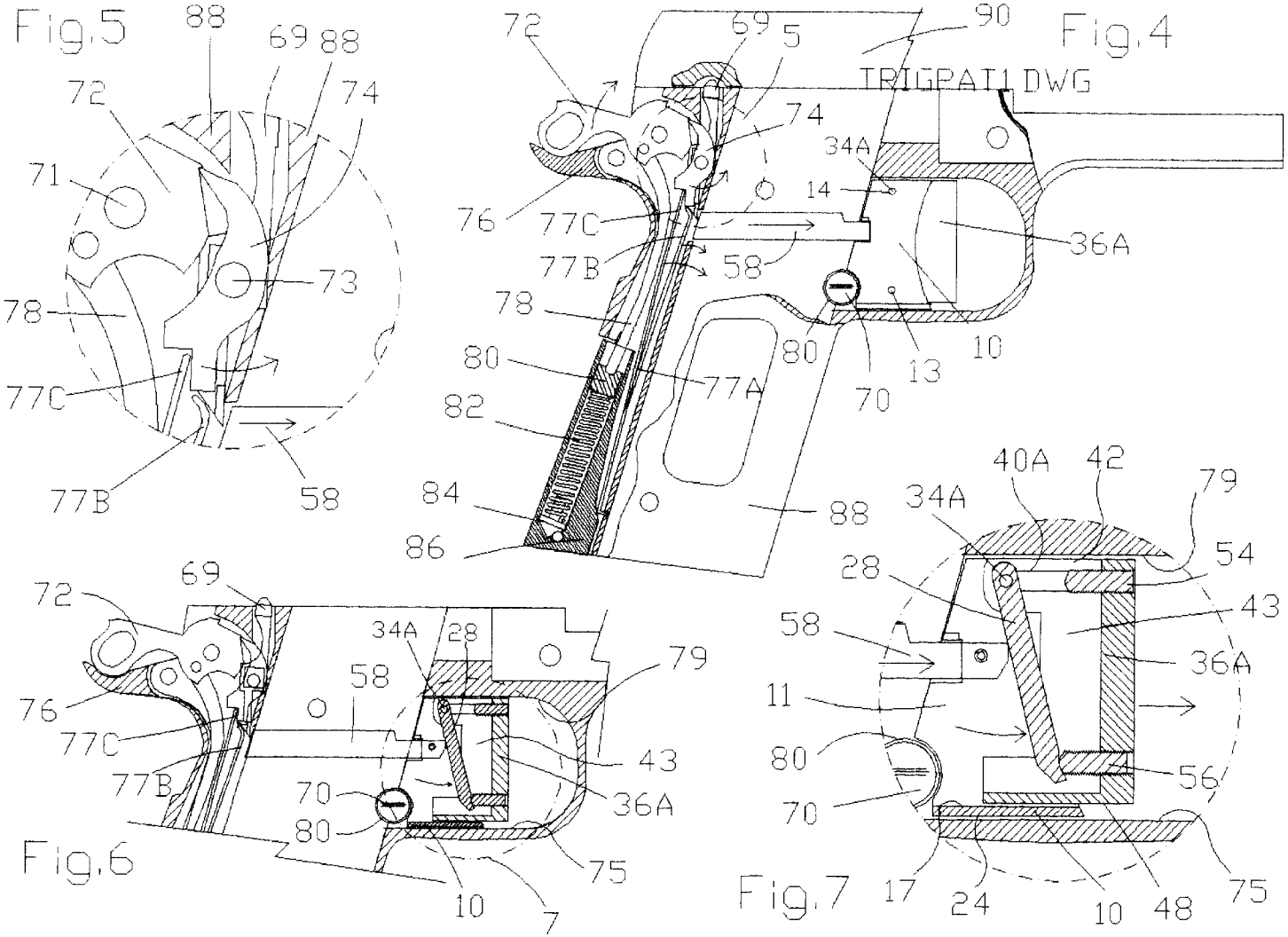
FIG. 4 shows cutaway portions of firearm and the related lockworks in a ready to fire position and also shows the right side view of the trigger device.
FIG. 5 shows enlarged view and portions of hammer, sear and springs in an engaged ready position.
FIG. 6 shows portion of firearm frame, lockworks in ready position and a cutaway view of the new trigger device
FIG. 7 shows enlarged cutaway view of the enclosure and portions cutaway view of the frame.
Figures 8A, 8B:
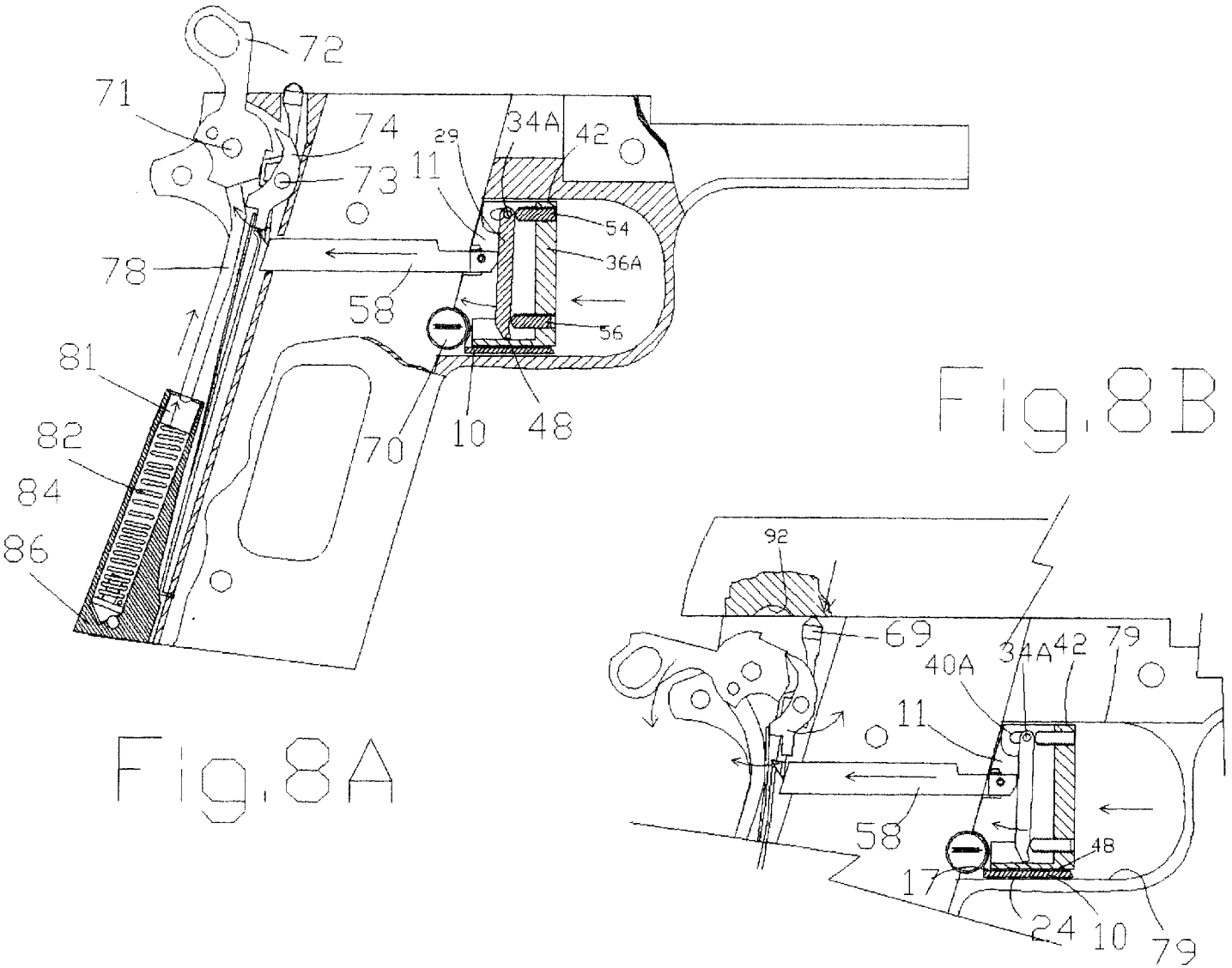
FIGS. 8A and 8B show firearm with the hammer lockworks in a forward or fired position with the trigger device in a depressed position

The secondary enclosure of the converter has a vertically cut link channel 43 that allows link 28 FIG. 7, (side view) to pass freely inside as it slides straightly to and fro inside of enclosure and an adjustable pre-load screw 56 (FIG. 6, FIG. 7, FIG. 8A and FIG, 8B) (side views) that is attached longitudinally will engaged with dimple 27 which is embedded on the outermost end of link 28 pushing and twisting the link 28 which produces torque along the mid portion where spacer nose 60 is being engaged and pushes spacer 58 and breaking off engagement between the hammer and sear converting the light pull and straight action. An adjustable stopper screw 54 FIG. 6, FIG. 7, FIG. 8A and FIG. 8B (side views) is also attached on the secondary enclosure that engages with link 28 and in-line with link 34A that stops and limits the over-travel of the secondary enclosure after firing.

Figures 3A, 3B, 3C:
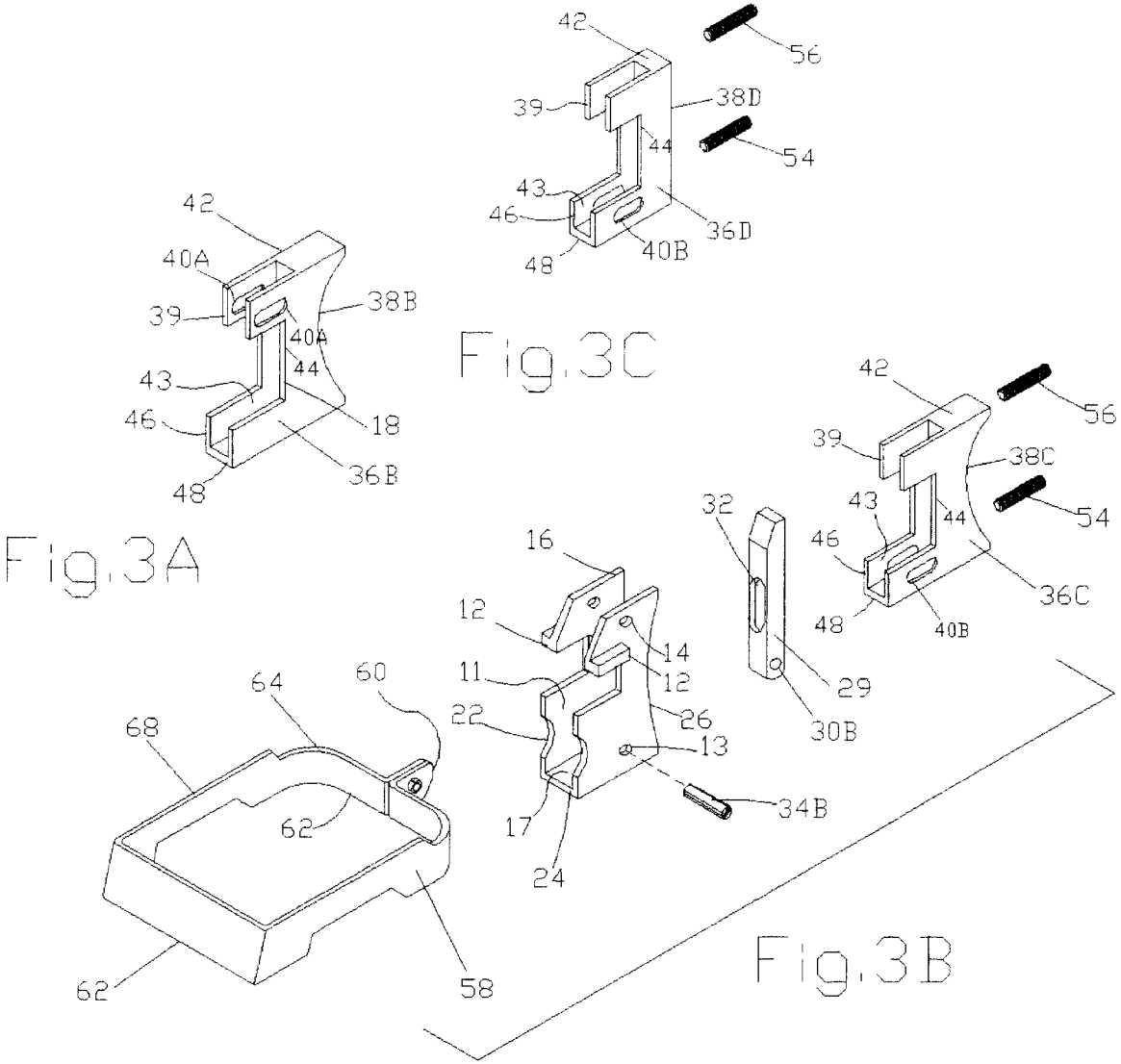
FIGS. 3A to 3C shows various aspects of the secondary enclosure supplied with various types of recess for the trigger finger.

Additional embodiments are shown FIGS. 3A to 3C. FIG. 3A shows another aspects of a preferred embodiment of secondary enclosure provided with arced finger thrust. FIG. 3B shows another preferred embodiment of link 29 and link pin are being disposed on the bottom end section with the outer end pointed upward and likewise the other related elements are also being disposed in reversed. However, the device can also be supplied with link 29 and link pin 34B that can also be connected on the lower link hole 13 (FIG. 3B) which allows the outer end of link 29 pointing upward which naturally aligns with trigger finger upon firing.

Operation—FIGS. 1A, 1B.

Figures 9A, 9B, 9C:
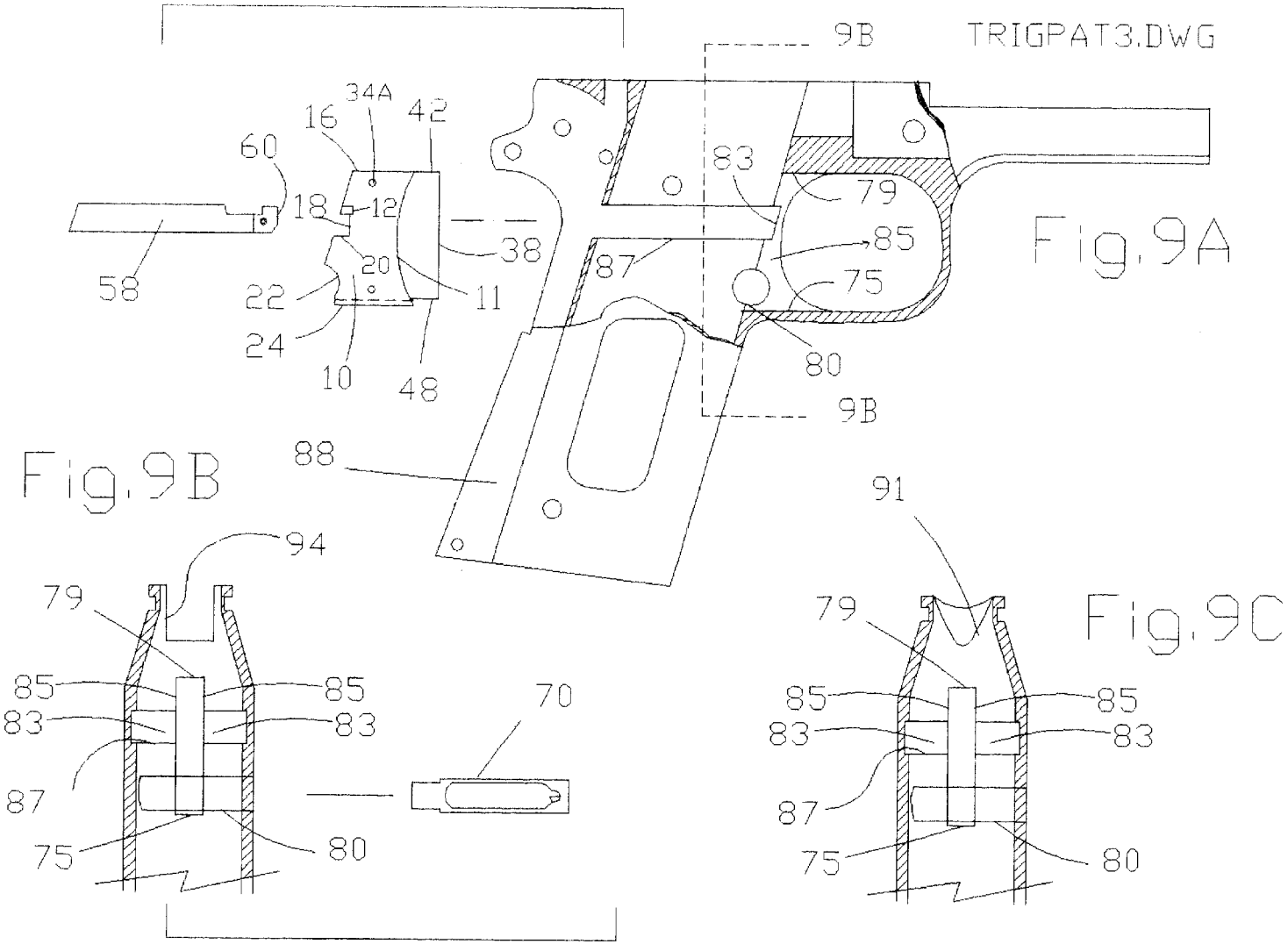
FIG. 9A shows portions of cutaway view of firearm with trigger device being removed as a module and also showing the firearm frame trigger channel which covers the trigger block and pivot pins.
FIG. 9B shows the rear view cutaway cross section of the firearm frame supplied with channel for barrels with integral ramp or supported barrels.
FIG. 9C shows another aspect of firearm supplied with integral ramp.

The manner of using the converter is to assemble link 28 inside of secondary enclosure 36A and secondary into enclosure 10 and align link hole 30A, slot 40A with link hole 14 on enclosure 10 and insert link pin 34A which will transform enclosure into a module FIG. 1B. Insert module into receiver trigger channel 85 FIG. 9A until catch 12 anchors rigidly against the end of the wall of spacer tunnel 83 (FIG. 9A). Insert and lock mag. button 70 into receiver button hole 80 which will engage with sliding fit against a recess 22 of enclosure 10 that will prevent enclosure from moving backward. Magazine button continues to operate in and out when depressed as in conventional manner.

Insert spacer 58 on receiver spacer channel 87 FIGS. 9A, 9B and 9C until spacer nose 60 engages with nose guide 32 of link 28. When hammer 72 is cocked by pulling slide 90 rearward and depressing of secondary enclosure 36A for firing the adjustable pre-load screw 56 will push against the outermost end of link 28 through dimple 27 twisting the link and producing a torque against the spacer releasing the hammer and sear engagement.

Accordingly, the reader will see that the trigger device of this invention will convert the trigger pull weight of firearms easily without firearm modifications, the disadvantageous rotational action of the link is being converted into a preferred straight action through utilization the bearing surfaces from firearm frame, enclosure and secondary enclosure, can be installed easily by transforming as a modular assembly, can easily be produced for achieving conventional mill and stamping machines with low production costs and obtain proper functioning of both trigger device and firearms and the enclosure can utilized both the standard and high capacity type magazines spacers. Furthermore, the trigger device has the additional advantages in that

- it will allow use of new or modified hammer or sear through adjustable trigger pre-load screw,
- it can be made in variety of light weight aircraft aluminum and composite materials in variety of colors,
- it can be made in light weight non-corrosive titanium and steels,
- it can be made with various secondary enclosure lengths for shooters of various hand size.

Summary, Ramification and Scope

Accordingly, the reader will see that the trigger device of this invention will convert firearms trigger pull weight consistently with substantial amount without any alterations on firearms hammer sear or sears and other related elements, the modular assembly will minimize or prevent elements from falling off during installation or disassembly, the enclosure is equipped with catches which extend sideways for anchoring rigidly against the frame simplifying construction and to eliminate firearm alteration, which utilize frame trigger tunnel as a cover for the link pin. Furthermore, the trigger device has the additional advantages in that

- it permit fast and easy installation without firearm modification
- it permits placements of link with link hole and link pin can be installed either on the upper or lower portion of the enclosure;
- it permits use of new or modified hammer or sear by application of easily adjustable pre-load screw by turning in or out until desired trigger play is attained;
- it permits the spacer and enclosure to overlap allowing both to occupy in same space and set fully forward against frame through provision of spacer overlapping recess and spacer guide of main enclosure;
- it permits rigid anchoring of enclosure with application of catches;
- it permits a straight pull secondary enclosure action by utilizing firearm trigger tunnel surface and converter surfaces as sliding bearing surfaces which function as a global advancing pivot point changing rotational link action into straight pull action,
- it permits portions of the enclosure and spacer to occupy in one same location and allow functioning in a very limited available space;
- it permits shifting of finger force towards the outermost end of link to attain a maximum torque through application of a pre-load screw converting firearm trigger weight substantially and consistently;

Although the description above contains many specifities, these should not be construed as limiting the scope of the invention. For example, the secondary enclosure can be provided with an arced shaped trigger finger thrust support recess on the front and lightening holes along the side to convert secondary enclosure mass weight.

I claim:

1. A hand held firearm having a receiver, receiver spacer tunnel, receiver tunnel, and a hammer lock-works, having a primary enclosure mechanism trigger converter device comprising a secondary enclosure mechanism including:

a) A link channel
b) retaining slots
c) a pre-load screw
d) a stopper screw
e) an enclosure for the converter housing
f) a catch
g) link holes
h) bearing surfaces
i) a spacer guide
j) a link
k) a link pin
l) a link dimple
m) a spacer
n) a spacer overlapping recess wherein said enclosure having said catch(es) used for self-anchoring on said receiver, a plurality of bearing surfaces on said enclosure and secondary enclosure, said link channel provides a passageway for said link when said secondary enclosure moves to and fro, the link holes, the link and the retaining slots on said secondary enclosure are arranged in line for attaching of said link pin and allows said secondary enclosure to move to and fro through said retaining slots and said link pin, thereby converting the said link rotational movement into a straight action, where said pre-load screw is adjustably attached to said secondary enclosure and set to engage with said dimple on said link when said secondary enclosure is depressed, thereby converting the force on said link and transmitting the force to said spacer, thus disengaging said hammer lockworks, the stopper screw is also adjustably attached onto said secondary enclosure which after disengagement of said hammer lock-works said stopper screw will engage and be in line with said link pin which limits the movement of said secondary enclosure, the spacer is provided with said spacer overlapping recess for insertion inside said spacer guide of said enclosure.

2. The trigger converter device of claim 1 wherein said link, said secondary enclosure, said pre-load screw and stopper screw and link holes on said enclosure can be made upside down position.

3. The trigger converter device of claim 1, wherein said link pin is installed on the enclosure, the secondary enclosure and the link, said enclosure is mounted on said receiver tunnel which covers and retains said link pin thereby preventing said secondary enclosure from falling forward while movable to and fro.

* * * * *